US006162387A

United States Patent [19]

Shimomura et al.

[11] Patent Number: 6,162,387

[45] Date of Patent: Dec. 19, 2000

[54] VACUUM REFINING FURNACE

[75] Inventors: Kensuke Shimomura, Futtsu; Tadashi Imoto, Hikari; Mayumi Okimori, Hikari; Gaku Ogawa, Hikari; Tomoaki Tanaka, Hikari, all of Japan

[73] Assignee: Nippon Steel Corporation, Tokyo, Japan

[21] Appl. No.: 09/000,219

[22] PCT Filed: Feb. 27, 1998

[86] PCT No.: PCT/JP98/00821

§ 371 Date: Sep. 18, 1998

§ 102(e) Date: Sep. 18, 1998

[30] Foreign Application Priority Data

Feb. 28, 1997 [JP] Japan ..... 9-060198

[51] Int. Cl.[7] ..... C21C 7/10

[52] U.S. Cl. ..... 266/208; 266/243; 266/903

[58] Field of Search ..... 266/207, 208, 266/211, 243, 903; 75/512

[56] References Cited

U.S. PATENT DOCUMENTS

| | | | |
|---|---|---|---|
| 3,632,097 | 1/1972 | Schurr, II | 266/243 |
| 3,764,124 | 10/1973 | Le Moyne | 266/208 |
| 3,854,932 | 12/1974 | Bishop, Jr. | 266/243 |
| 4,149,706 | 4/1979 | De Graaf | 266/903 |

FOREIGN PATENT DOCUMENTS

| | | | |
|---|---|---|---|
| 2564861 | 11/1985 | France | 266/208 |
| 58-39885 | 9/1983 | Japan . | |
| 1 123198 | 11/1989 | Japan . | |
| 8-283831 | 10/1996 | Japan . | |
| 10-25510 | 1/1998 | Japan . | |
| 97567 | 5/1973 | United Kingdom . | |

OTHER PUBLICATIONS

Patent Abstracts of Japan, vol. 015, No. 092 (C–0811) Mar. 6, 1991 –JP 02–305916.

Patent Abstracts of Japan, vol. 014, No. 237, (M–0976) May 21, 1990–JP 02–063646.

Supplementary European Search Report, EP 98 90 5694, Apr.5, 2000.

*Primary Examiner*—Scott Kastler
*Attorney, Agent, or Firm*—Kenyon & Kenyon

[57] ABSTRACT

A refining furnace used for vacuum refining has a sealing cover mounted on the refining furnace so as to cover the furnace throat of the refining furnace and to be in close contact with a sealing flange (10) formed on the refining furnace. The adhesion of metal and slag to the sealing flange is prevented without using any flange cover. A sealing flange (10) is formed on the outer surface of the refining furnace (1) at a position on a conical part (8) extending between the furnace throat (9) and a straight body part or on the straight body part. A slag-stopping dummy flange (11) is formed on the outer surface of the refining furnace (1) at a position between a furnace throat (9) and the sealing flange (10). The slag-stopping dummy flange (11) has an outer circumference lying on the inner side of the inner circumference of a sealing cover (4) and on the outer side of the inner circumference of a lower end part of a dust collecting hood for atmospheric refining.

8 Claims, 5 Drawing Sheets

VACUUM REFINING FURNACE

TECHNICAL FIELD

The present invention relates to a tilting vacuum refining furnace, such as a vacuum converter or a vacuum AOD furnace, having a furnace body having a furnace throat, and a detachable sealing cover for sealing the furnace body to form a sealed space for use in the vacuum refining of a molten metal.

BACKGROUND ART

Prior art vacuum refining techniques which employs a refining furnace, such as a converter, connected to a pressure reducing system, have been disclosed in, for example, Japanese Laid-open Patent Application Publication Nos. 82418/82, 163549/83, 181829/83, 207311/83 and 305916/90, and Japanese Laid-open Utility model Application Publication No. 156164/85. A method of hermetically connecting a pressure reducing system to a refining furnace is mentioned specifically in, for example, Japanese Laid-open Patent Application No. 305916/90. A refining furnace mentioned in the publication comprises, in combination, a tiltable furnace body, a duct to be connected to an evacuating apparatus, and a hood having a sealing flange detachably joined to an upper part of the furnace body. The furnace body comprises a vessel provided with tuyeres in its bottom, and a conical partjoined to the vessel by a flange joint. The furnace body is provided with a sealing flange formed by expanding a part of the vessel or the conical part, and the sealing flange of the hood is seated on the sealing flange of the furnace body with an annular gasket placed therebetween to make a hermetic sealing joint between the sealing flanges.

If an amount of metal or slag which cannot be absorbed by the elastic deformation of the gasket adheres to or deposit on the sealing surface of the sealing flange of the furnace body, a reliable hermetic sealing joint cannot be made between the hood and the furnace body. It often occurs that metal and slag sputtered from within the refining surface or those once accumulated on a dust collecting hood, a furnace sealing cover or the like and fallen on the refining furnace adhere to or deposit on the furnace body. Therefore, the adhesion of metal and slag to and deposition of the same on the sealing flange must be prevented to ensure a reliable hermetic sealing joint.

As shown in FIG. 5A, a prior art refining furnace sealing method disclosed in Japanese Laid-open Patent Application Publication No. 82418/82 covers a throat flange 21 for use in hermetically sealing a furnace throat 25 formed in a refining furnace, and a taphole flange 23 for use in hermetically sealing a taphole 26 formed in the refining furnace with flange covers 22 and 24, respectively, while the refining furnace is in a state other than a vacuum refining process. The flange covers 22 and 24 prevent the adhesion of metal and slag to the flanges 21 and 23, so that a reliable hermetic sealing joint can be made for vacuum refining. The furnace throat 25 is closed by a furnace throat cover 27 and the taphole 26 is covered by a taphole cover 29 connected to an evacuating device 32 as shown in FIG. 5B upon the completion of ordinary blowing at the atmospheric pressure, and then the refining furnace is evacuated through the taphole cover 29 for degassing and refining.

Also shown in FIG. 5B are a suction pipe 28, a cooling device 30, a dust separator 31 and inert gas blowing nozzles 33.

In the refining furnace of such a construction, the flange covers 22 and 24 need to be put on the flanges 21 and 23 every time the operating mode of the refining furnace is changed from an atmospheric refining mode to a vacuum refining mode and need to be removed from the flanges 21 and 23 every time the operating mode of the refining furnace is changed from the vacuum refining mode to the atmospheric refining mode, which requires additional work using a crane or the like, and increases process time. The increase in process time reduces the productivity of the refining furnace and causes increase in wear of the refractory lining of the refining furnace due to the extension of time for which the high-temperature molten metal is held in the refining furnace. Mechanisms for holding the flange covers 22 and 24 in place are necessary to prevent the flange covers 22 and 24 from falling when tilting the refining furnace. Thus the prior art refining furnace has problems in reliability and maintainability.

SUMMARY OF THE INVENTION

According to one aspect of the present invention, a vacuum refining furnace which refines a molten metal in an evacuated, sealed space formed therein by bringing a gasket, namely, a sealing member, attached to a lower end part of a hood for removably covering a furnace throat, namely, a sealing cover, into close contact with a sealing flange formed on the outer surface of a conical part, namely, sloping part, extending from a furnace throat to a straight body part or in the straight body part is provided with a slag-stopping dummy flange having an outer circumference lying on the inner side of the inner circumference of the lower end of the sealing cover and on the outer side of the inner circumference of a lower end part of a dust collecting hood for atmospheric refining, and formed on the outer surface of the vacuum refining furnace at a position between the furnace throat and the sealing flange.

According to the present invention, the vacuum refining furnace may be provided with the slag-stopping dummy flange at a position in a range between the sealing flange and the lower end of a taphole formed at a position between the furnace throat and the sealing flange. In a longitudinal sectional view of the refining furnace, a straight line connecting a point on the outer circumference of the sealing flange and a point on the circumference of the furnace throat, and a straight line connecting points respectively on the inner and the outer circumference of the slag-stopping dummy flange intersect each other. In a longitudinal sectional view of the refining furnace, a straight line connecting a point on the outer circumference of the sealing flange and an outermost point on the taphole, and a straight line connecting points respectively on the inner and the outer circumference of the slag-stopping dummy flange intersect each other.

The present invention enables the omission of a special protective cover employed in the prior art vacuum refining furnace to cover the sealing flange, enables saving time necessary for placing the protective cover on and removing the same from the sealing flange, reduces greatly time necessary for cleaning the sealing flange before starting vacuum refining, and enhances the productivity of the vacuum refining furnace.

PREFERRED MODE FOR CARRYING OUT THE INVENTION

Figure 1:
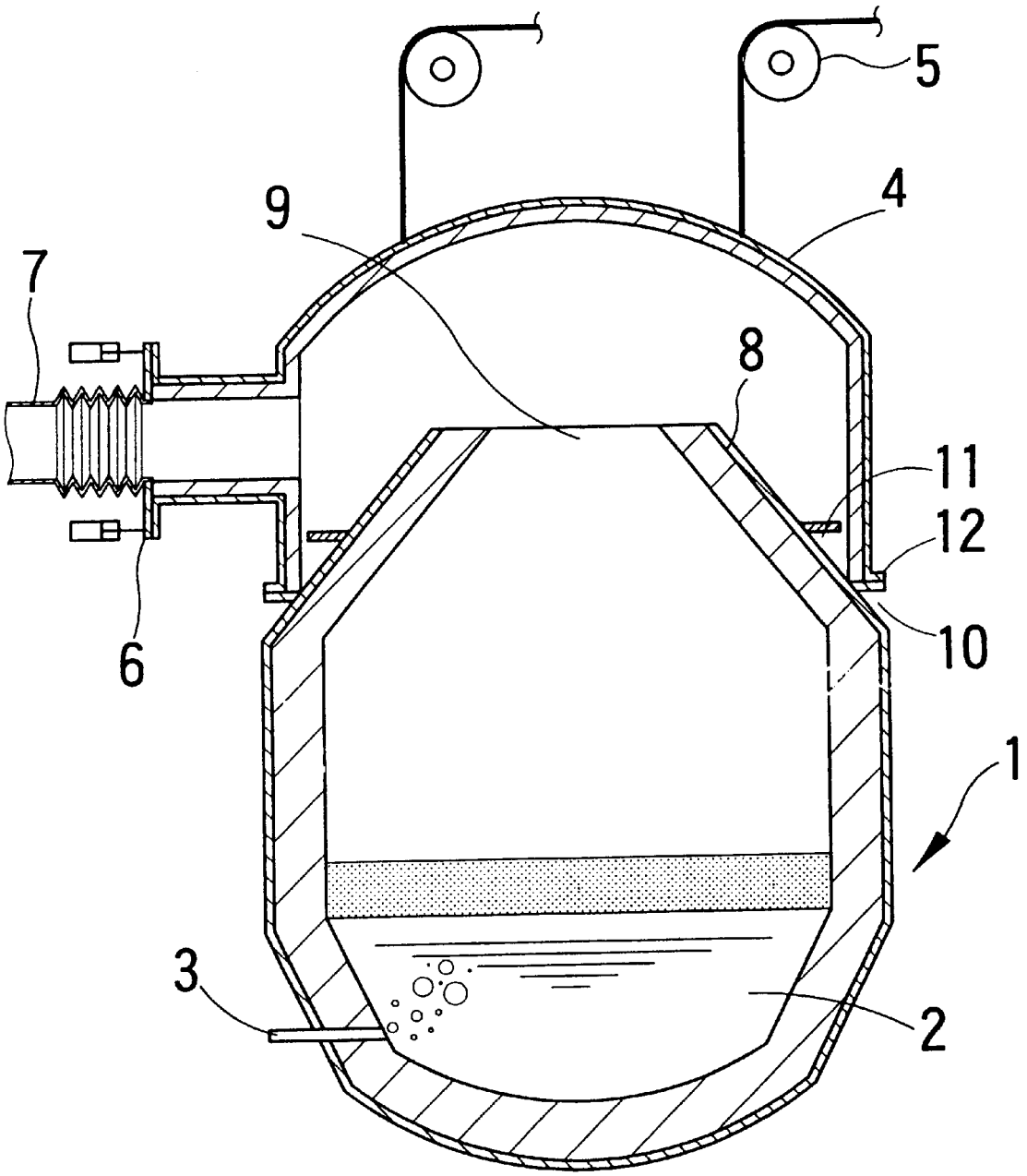
FIG. 1 is a longitudinal sectional view of a vacuum refining furnace having a conical part not provided with any taphole, and provided with a slag-stopping dummy flange according to the present invention.

FIG. 1 shows a vacuum refining furnace fixedly provided with a slag-stopping dummy flange in a preferred embodiment according to the present invention. Any foreign matters, such as metal and slag, must not exist on an upper surface of a sealing flange 10 to ensure reliable, hermetic sealing contact between a furnace body 1 and a sealing cover 4. The deposition of metal and slag sputtered through a furnace throat 9 or those once accumulated on and fallen from a dust collecting hood, not shown, for atmospheric refining on or adhesion of the same to the sealing flange 10 must be reduced. According to the present invention, a slag-stopping dummy flange 11 having an outside diameter smaller than the inside diameter of a sealing cover 4 is attached to a conical part 8 of the furnace body 1 to shield the sealing flange 10 from metal and slag.

Figure 2:
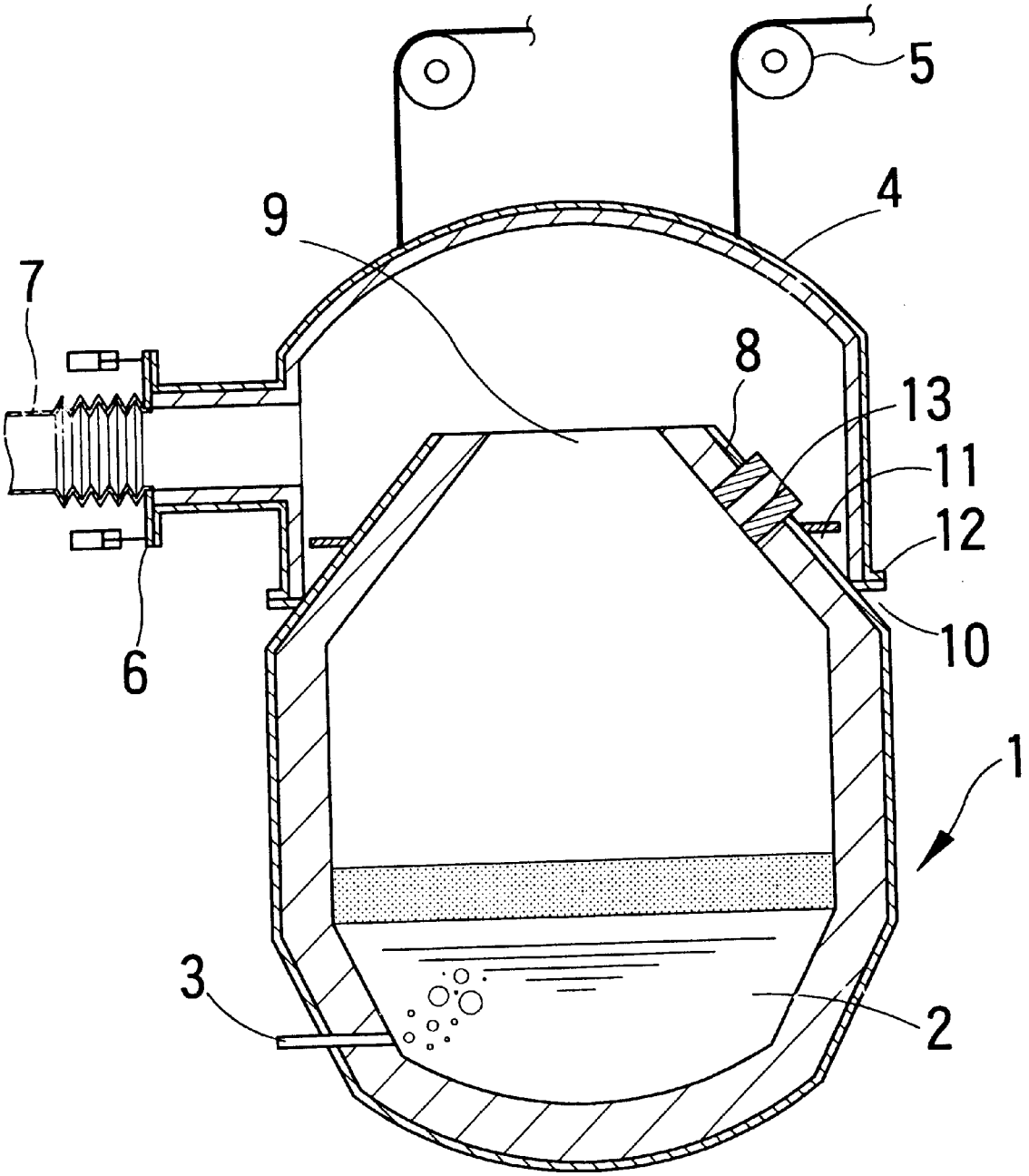
FIG. 2 is a longitudinal sectional view of a vacuum refining furnace having a conical part provided with a taphole, and provided with a slag-stopping dummy flange according to the present invention.

FIG. 2 shows a vacuum refining furnace having a conical part 8 provided with a taphole 13. In this vacuum refining furnace, metal and slag are sputtered through the taphole 13, and metal and slag drip from the taphole 13 when and after tapping molten metal through the taphole 13. According to the present invention, a slag-stopping dummy flange 11 is attached to the conical part 8 at a position between the taphole 13 and a sealing flange 10.

The position of a slag-stopping dummy flange according to the present invention will be described with reference to FIG. 3.

Figure 3:
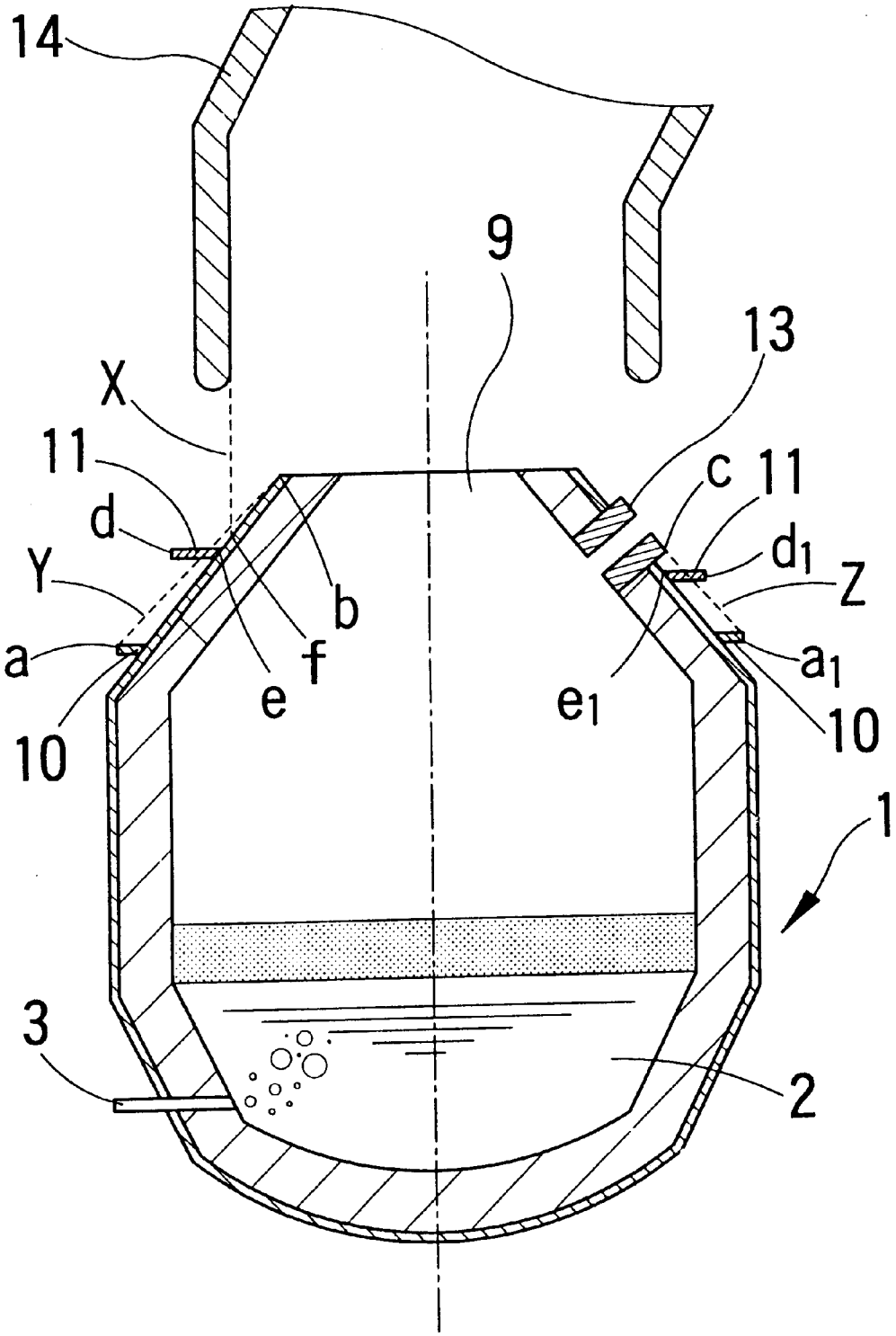
FIG. 3 is a longitudinal sectional view of a vacuum refining furnace, showing the respective positions of both the slag-stopping dummy flanges shown in FIGS. 1 and 2.

Referring to FIG. 3, a point d on the outer circumference of a slag-stopping dummy flange 11 attached to a conical part of a vacuum refining furnace 1 must lie on the outer side of the intersection f of a vertical straight line X extending from the inner circumference of a lower end part of a dust collecting hood 14 disposed for atmospheric refining above the vacuum refining furnace 1, and the outer surface of the conical part. It is necessary only to meet a condition that the diameter of the slag-stopping dummy flange 11 is smaller than the inside diameter of the lower end part of the sealing cover 4 (FIGS. 1 and 2) to avoid obstructing operations for putting the sealing cover 4 on and removing the same from the vacuum refining furnace 1, and the slag-stopping dummy flange 11 need not cover the sealing flange 10 entirely.

The greater the length of projection of the slag-stopping dummy flange 11, the greater the effect of the slag-stopping dummy flange 11 on preventing the drip of slag. Therefore, the point d on the outer circumference of the slag-stopping dummy flange 11 must lie on the outer side of a straight line Y connecting a point a on the outer circumference of the sealing flange 10 and a point b on the outer circumference of the furnace throat 9 as shown in a left half of FIG. 3; that is, the slag-stopping dummy flange 11 may be formed so that a straight line connecting the point d on the outer circumference of the slag-stopping dummy flange 11 and a point e on the inner circumference of the same intersect the straight line Y connecting the point a on the outer circumference of the sealing flange 10 and the point b on the circumference of the furnace throat 9.

If a taphole 13 is formed in a conical part as shown in a right half of FIG. 3, a point $d_1$ on the outer circumference of the slag-stopping dummy flange 11 must lie on the outer side of a straight line Z connecting a point $a_1$ on the outer circumference of the sealing flange 10 and a point c on the outermost end of the taphole 13; that is, the slag-stopping dummy flange 11 may be formed so that a straight line connecting the point $d_1$ on the outer circumference of the slag-stopping dummy flange 11 and a point $e_1$ on the inner circumference of the same intersect the straight line Z.

To achieve an object of the present invention, it is desirable that the slag-stopping dummy flange 11 has an annular shape corresponding to the entire circumference of the vacuum refining furnace 1. However, if metal and slug are sputtered mostly in a particular direction because the furnace throat 9 has an asymmetric shape or because of the orientation of a bottom tuyere 3, the vacuum refining furnace 1 may be provided with a partial slag-stopping dummy flange only in a circumferential region of the outer surface of the vacuum refining furnace 1 in which metal and slag are sputtered mostly. An asymmetric refining furnace having a furnace throat which is not horizontal when the refining furnace is set upright for atmospheric refining need not be provided with any slag-stopping dummy flange in its half circumferential part thereof on the side of a higher half of the furnace throat. A refining furnace provided with a taphole needs a slag-stopping dummy flange disposed in a region below the taphole. It is also possible to form a slag-stopping dummy flange in a partly spiral shape so that a section of the slag-stopping dummy flange on the side of the taphole 13 and a section of the same on the opposite side of the taphole 13 are on different levels, respectively, as shown in FIG. 3.

It is preferable to form the slag-stopping dummy flange as flat as possible in a construction that makes it difficult for metal and slag to adhere to the slag-stopping dummy flange and to form the slag-stopping dummy flange from a material that makes it difficult for metal and slag to adhere to the slag-stopping dummy flange. More specifically, it is preferable to form the slag-stopping dummy flange so that heads of bolts and joints of plates are not exposed on the upper surface thereof and to attach the slag-stopping dummy flange to the furnace body by welding so that the slag-stopping dummy flange are incorporated integrally into the furnace body.

The slag-stopping dummy flange is liable to be heated partially from the side of its upper surface by metal and slag adhering thereto and hence is subject to thermal deformation. Therefore, it is desirable to form the slag-stopping dummy flange from a steel plate having a sufficient thickness or to form the slag-stopping dummy flange in a structure having a sufficient rigidity by reinforcing the lower surface thereof by ribs joined to the surface of the furnace body. It is also preferable to form the flange in a water-cooled structure.

EXAMPLE

A vacuum refining furnace 1 provided with a slag-stopping dummy flange of a construction as shown in FIG. 1 was operated for about 30 min for atmospheric refining, and then a sealing cover 4 was put on the vacuum refining furnace 1 and a vacuum refining process was carried out.

A sealing cover 4 can be lowered onto the vacuum refining furnace 1 by a lifting mechanism 5. The vacuum refining furnace 1 is evacuated by an evacuating system, not shown, through a duct 7 connected by an expansion joint 6 to the sealing cover 4. A hermetic sealing joint is made between the vacuum refining furnace 1 and the sealing cover 4 by closely joining together a sealing flange 10 formed on the vacuum refining furnace 1 and a lower end part 12 of the sealing cover 4 with a sealing member, a packing, not shown, or a gasket, not shown, compressed between the sealing flange 10 and the lower end part 12 of the sealing cover 4.

Figure 4:
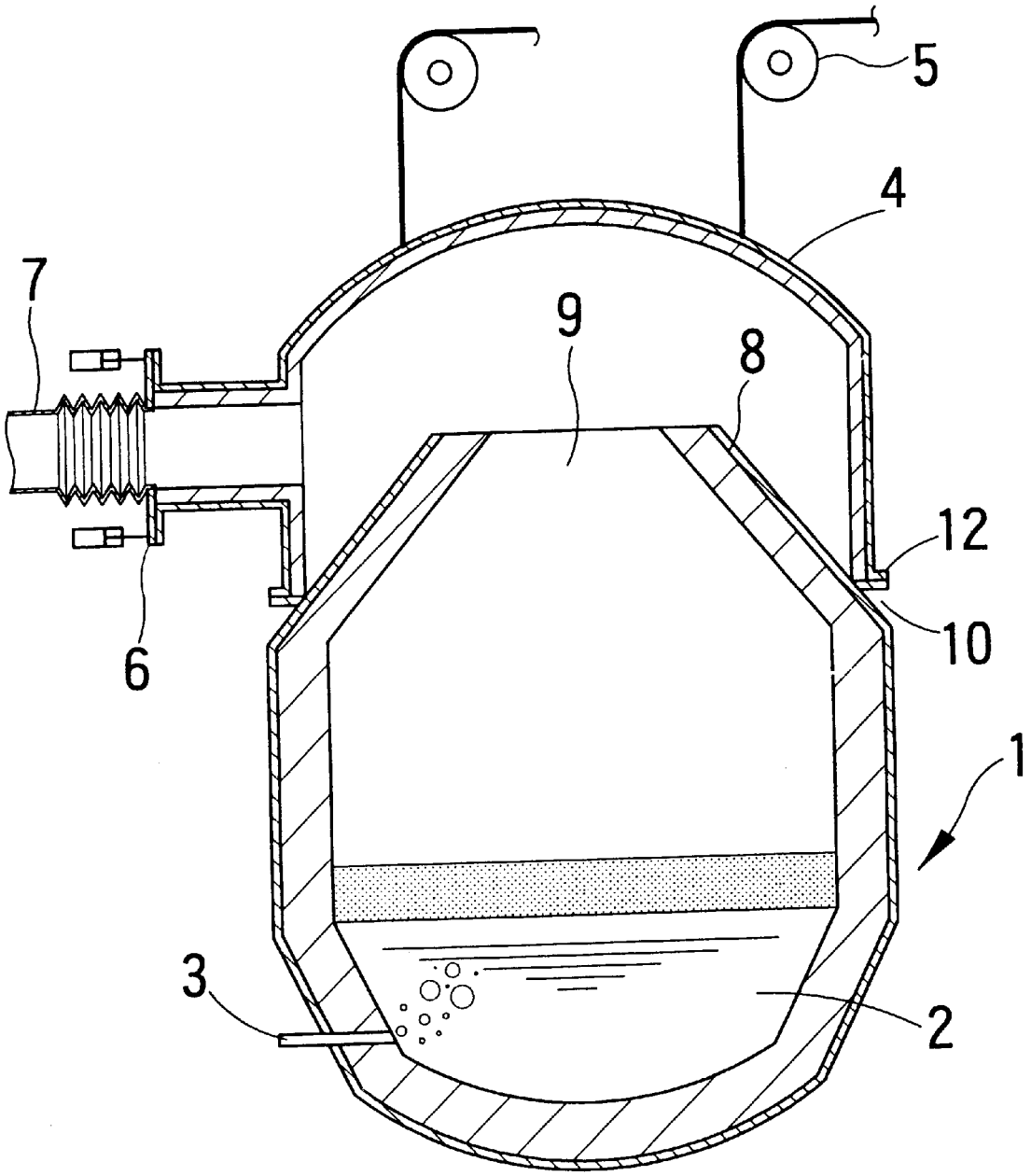
FIG. 4 is a longitudinal sectional view of a conventional vacuum refining furnace not provided with any slag-stopping dummy flange.
Figure 5A:
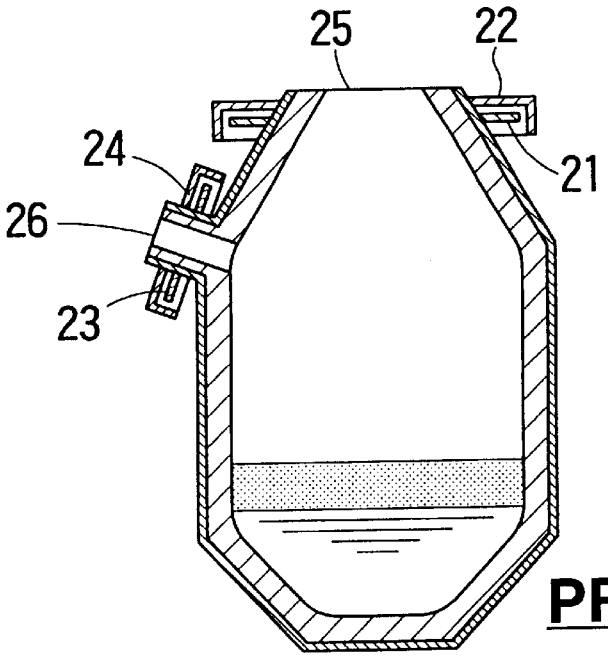
PRIOR ART FIG.5A
FIGS. 5A and 5B are longitudinal sectional views of a conventional vacuum refining furnace employing detachable flange covers.
Figure 5B:
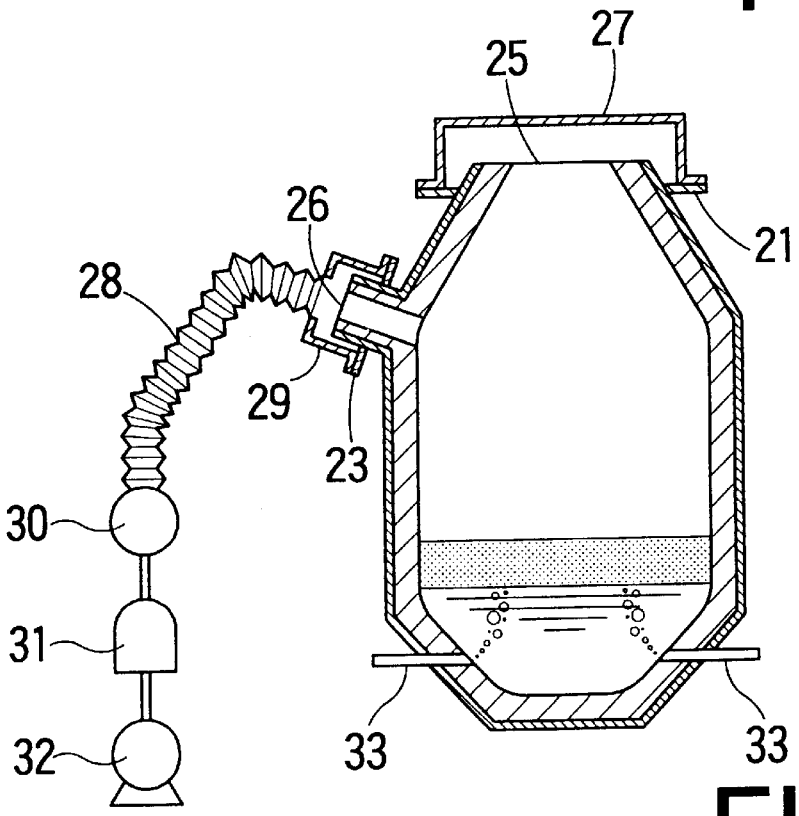
FIG.5B PRIOR ART

The average of times required for clearing the sealing flange 10 of metal and slag adhering thereto in refining ten heats of metal was 0.6 min and the sealing flange 10 could be cleared of metal and slag simply by blowing compressed air against the sealing flange. When a conventional vacuum refining furnace as shown in FIG. 4 was operated for the same refining process, the average of times required for clearing the sealing flange 10 of metal and slag adhering thereto in refining ten heats of metal was 3.2 min, the sealing flange could not be perfectly cleared of metal and slag only by blowing compressed air against the sealing flange 10, and the sealing flange 10 needed manual cleaning work using a bar.

A vacuum refining furnace 1 shown in FIG. 2 provided with the taphole 13 was operated for about 30 min for atmospheric refining, and then the sealing cover 4 was put on the vacuum refining furnace 1 and a vacuum refining process was carried out. The average of times required for clearing the sealing flange 10 of metal and slag adhering thereto in refining ten heats of metal was 0.8 min, the sealing flange 10 could be cleared of metal and slag simply by blowing compressed air against the sealing flange 10 and any metal removing work using a bar or the like was not necessary. When this vacuum refining furnace 1 was operated for the same refining process before the vacuum refining furnace 1 was provided with the slag-stopping dummy flange 11, the average of times required for clearing the sealing flange 10 of metal and slag adhering thereto in refining ten heats of metal was 4.5 min, and metal removing work using a bar or the like was necessary.

What is claimed is:

1. A vacuum refining furnace system for refining molten metal in an evacuated and sealed space, said system comprising:

a refining furnace having a furnace throat;

a sealing flange disposed on an outer surface of the refining furnace;

a sealing cover removably attached to the refining furnace so as to cover the furnace throat and to define the evacuated and sealed space, the sealing cover having a lower end part sealingly engageable with the sealing flange;

a slag-stopping dummy flange disposed on the outer surface of the refining furnace at a position between the furnace throat and the sealing flange, the dummy flange having an outer circumference located inside of an inner circumference of the lower end part of the sealing cover.

2. The furnace system according to claim 1, wherein, as viewed in a longitudinal sectional view of the refining furnace, a straight line (Y) connecting a point (a) on the outer circumference of the sealing flange and a point (b) on an outer circumference of the furnace throat, and a straight line connecting points (e and d) respectively on an inner circumference and the outer circumference of the slag-stopping dummy flange intersect each other.

3. The furnace system according to claim 1, wherein, as viewed in a longitudinal sectional view of the refining furnace, a straight line (Z) connecting a point (a1) on the outer circumference of the sealing flange and an outermost point (c) on the taphole, and a straight line connecting points (e1 and d1) respectively on an inner circumference and the outer circumference of the slag-stopping dummy flange intersect each other.

4. The furnace system according to claim 1, wherein the outer surface of the refining furnace includes a conical portion extending downwardly from the furnace throat, and wherein the dummy flange is disposed on the conical portion.

5. The furnace system according to claim 1, further comprising a dust collecting hood engageable with the refining furnace for atmospheric refining, the hood having an inner circumference at a lower end part thereof, wherein the dummy flange is located outside of the inner circumference of the hood.

6. The furnace system according to claim 1, wherein the refining furnace is provided with a taphole, and wherein the slag-stopping dummy flange is disposed at a position between a lower end of the taphole and the sealing flange.

7. The furnace system according to claim 6, wherein a distance between the slag-stopping dummy flange and the sealing flange is greater than a distance between the slag-stopping dummy flange and the lower end of the taphole.

8. The furnace system according to claim 6, wherein, as viewed in a longitudinal sectional view of the refining furnace, a straight line (Y) connecting a point (a) on the outer circumference of the sealing flange and a point (b) on an outer circumference of the furnace throat, and a straight line connecting points (e and d) respectively on an inner circumference and the outer circumference of the slag-stopping dummy flange intersect each other.

* * * * *